US006939420B2

(12) United States Patent
Pollack

(10) Patent No.: US 6,939,420 B2
(45) Date of Patent: Sep. 6, 2005

(54) THICKENED WATER IN OIL EMULSION COMPOSITION

(75) Inventor: Robert A. Pollack, Auburn, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/415,678

(22) PCT Filed: Nov. 1, 2001

(86) PCT No.: PCT/US01/50488

§ 371 (c)(1),
(2), (4) Date: May 1, 2003

(87) PCT Pub. No.: WO02/40428

PCT Pub. Date: May 23, 2002

(65) Prior Publication Data

US 2004/0020574 A1 Feb. 5, 2004

Related U.S. Application Data

(60) Provisional application No. 60/245,174, filed on Nov. 20, 2000.

(51) Int. Cl.[7] ..... C06B 45/00; C06B 31/28
(52) U.S. Cl. ..... 149/2; 149/46
(58) Field of Search ..... 149/46, 2

(56) References Cited

U.S. PATENT DOCUMENTS 4,808,251 A * 2/1989 Ghosh et al. ..... 149/2
4,820,361 A * 4/1989 McKenzie et al. ..... 149/2
5,401,341 A 3/1995 Forsberg et al. ..... 149/46
5,936,194 A 8/1999 Marlow et al. ..... 149/2

FOREIGN PATENT DOCUMENTS

| | | |
|---|---|---|
| EP | 0276934 A2 | 8/1988 |
| EP | 0403091 B1 | 6/1994 |
| EP | 0937695 A1 | 8/1999 |
| EP | 0621249 B1 | 9/1999 |
| GB | 2259090 A | 3/1993 |
| WO | WO 00/17130 | 3/2000 |

* cited by examiner

*Primary Examiner*—Aileen B. Felton
(74) *Attorney, Agent, or Firm*—Samuel B. Laferty; Michael F. Esposito

(57) ABSTRACT

A putty-like water-in-oil emulsion composition comprising a) an aqueous phase, said aqueous phase comprising water and an inorganic salt, wherein a portion of the inorganic salt is present in aqueous solution and a portion is present in crystalline form, b) an organic phase comprising at least one hydrocarbon, and c) an associated mixture of an emulsifying amount of at least one emulsifying agent comprising at least one of hydroxy groups and amino groups; said emulsifying agent suitable for forming a water-in-oil emulsion, and an acylated hydrocarbon polymer, said hydrocarbon polymer having $\bar{M}_n$ ranging from about 2,000 to about 6,000.

24 Claims, No Drawings

THICKENED WATER IN OIL EMULSION COMPOSITION

This application claims benefit of provisional application 60/245,174 filed Nov. 20, 2000.

FIELD OF THE INVENTION

This invention relates to thickened water-in-oil emulsion compositions, for example an explosive emulsion, having a putty-like consistency.

BACKGROUND OF THE INVENTION

Water-in-oil emulsions typically comprise a continuous organic phase and a discontinuous aqueous phase. Energetic emulsion compositions such as explosive emulsions and propellant emulsions contain water and an oxygen-supplying source such as ammonium nitrate in the aqueous phase, the aqueous phase being dispersed throughout the continuous organic phase which comprises an organic fuel. Energetic emulsion compositions, for example explosive emulsions are known to those skilled in the art. Cap-sensitive explosive emulsions are water-in-oil explosive emulsions which can be detonated without the use of a booster. Such emulsion explosives are also known to those skilled in the art. Propellant emulsions such as rocket propellants are also known.

U.S. Pat. No. 3,130,096 discloses a propellant composition in which a mixture of diglycidyl ethers is cured to form a binder which is admixed with an oxidizer material. The binder also functions as a fuel.

U.S. Pat. No. 3,177,101 discloses a gas-generating composition proposed by mixing a carboxyl terminated liquid polyester with ammonium nitrate powder and a curing agent. The curing agent reacts with the carboxyl portion of the liquid polyester, and the material sets to a solid consistency. The patent distinguishes between gas-generating compositions, propellants, and explosives by noting that gas-generating compositions have a substantially lower burning rate than conventional propellants, just as propellants have a substantially lower burning rate than explosives.

U.S. Pat. No. 3,790,416 discloses a composite propellant composition in which dewetting of the propellant composition under applied stress is substantially reduced. Reduced dewetting is achieved through the use of poly-functional amines which are capable of forming a chemical bond between the oxidizer (oxygen-containing ammonium salt) and the binder in the cured propellant. The composite propellant composition comprises oxidizers and optionally fuels in the form of small solid particles uniformly distributed in a polymeric binder.

U.S. Pat. No. 4,104,092 discloses gelled explosive compositions which are sensitized with water-in-oil explosive emulsions. The gelled explosive compositions basically comprise an aqueous solution of oxidizers, fuels and sensitizing agents which have been gelled with one or a variety of aqueous gelling agents such as guar gum and a suitable cross-linker. The patented compositions are distinguished from water-in-oil emulsion explosives in that emulsion explosives are comprised of two distinct phases, the carbonaceous oil being the continuous phase and the aqueous solution of the oxidizing agents being the discontinuous phase of the emulsion.

U.S. Pat. No. 4,216,040 discloses an inverted phase or water-in-oil blasting composition having a water-immiscible liquid organic fuel as a continuous phase, an emulsified aqueous inorganic oxidizer salt solution as a discontinuous phase, and an organic cationic emulsifier having a hydrophilic portion and a lipophilic portion, wherein the lipophilic portion is an unsaturated hydrocarbon chain. Thickening and cross-linking agents are not necessary for stability and water-resistancy. However, such agents can be added if desired. The aqueous solution of the composition can be rendered viscous by the addition of one or more thickening agents of the type and in the amount commonly employed in the art. Such thickening agents include galactomannin (preferably guar gums); guar gum of reduced molecular weight, biopolymer gums, polyacrylamide and analogous synthetic thickeners, flours, and starches. Cross-linking agents for cross-linking the thickening agents also are well known in the art. Such agents are usually added in trace amounts and usually comprise metal ions such as dichromate or antimony ions. The liquid organic, which forms the continuous phase of the composition, also can be thickened, if desired, by use of a thickening agent which functions in an organic liquid.

U.S. Pat. No. 4,343,663 discloses self-supporting, water-bearing explosive products which contain discreet cells of an aqueous solution of an inorganic oxidizing salt and/or an amine salt encapsulated by a cross-linked (thermoset) resin matrix.

U.S. Pat. No. 4,420,349 describes a two-component emulsion explosive composition consisting of a continuous oil/fuel phase and a discontinuous oxidizer salt phase and, as an emulsifier, a dimer acid glyceride wherein the dimer acid has a carbon chain length of C18–C60. The composition is said to demonstrate superior properties of long period storage stability and sensitivity.

U.S. Pat. No. 4,473,418 discloses an emulsion explosive composition which may include thickening and/or cross-linking agents. The typical thickening agents include natural gums, such as guar gum or derivatives thereof, and synthetic polymers, particularly those derived from acrylamide. Water-insoluble polymeric or elastomeric materials, such as natural rubber and synthetic rubber, may be incorporated into the oil phase. The cross-linking agents are not further specified.

U.S. Pat. No. 4,525,225 discloses a solid water-in-oil emulsion explosive comprising a discontinuous emulsion phase formed of an aqueous solution of an oxidizer salt and a continuous emulsion phase formed of a solid carbonaceous fuel derived from an oleaginous liquid.

U.S. Pat. No. 4,708,753 discloses that emulsion explosives may contain water phase or hydrocarbon phase thickeners such as guar gum, polyacrylamide, carboxymethyl or ethyl cellulose, biopolymers, starches, elastomeric materials and the like as well as cross-linkers for the thickeners, such as potassium pyroantimonate and the like.

U.S. Pat. No. 4,822,433 discloses an explosive emulsion composition comprising a discontinuous phase containing an oxygen-supplying component and an organic medium forming a continuous phase wherein the oxygen-supplying component and organic medium are capable of forming an emulsion which, in the absence of a supplementary adjuvant, exhibits an electrical conductivity measured at 60° C., not exceeding 60,000 picomhos/meter. The conductivity may be achieved by the inclusion of a modifier which also functions as an emulsifier.

U.S. Pat. No. 4,936,932 relates to an explosive emulsion composition comprising a discontinuous oxidizer phase and a continuous fuel phase comprising an aromatic hydrocarbon compound. The composition essentially contains as the emulsifying agent a polyisobutylene succinic anhydride based compound in admixture with 1–4 sorbitan and oleic acid. The composition is said to demonstrate high explosive strength and excellent stability.

U.S. Pat. No. 5,244,475 discloses an emulsion composition with a polymerizing and/or cross-linking agent and method for its use in improving the manufacturing, packaging, transporting, storage placement and blasting characteristics of explosives containing an emulsion. More specifically, compositions and methods directed to controlling the rheology of an emulsion or explosive containing an emulsion by polymerizing and/or cross-linking the continuous phase of the emulsion by employing hydroxy-terminated polybutadiene and polymerization agents and/or maleic anhydride adducted polybutadiene and cross-linking agents, but without compromising the integrity of the explosive reaction.

U.S. Pat. No. 5,401,341 relates to a water in oil emulsion explosive containing an oxidizing material in the discontinuous water phase, and the continuous oil phase acts as a carbonaceous fuel. The patent relates to such explosives in which polyfunctional carboxylic acids, sulfonic acids, or phosphorous-containing acids, soluble in the oil phase are caused to cross-link using an inorganic cross-linker, thereby causing the viscosity of the emulsion to increase.

U.S. Pat. No. 5,936,194 describes thickened emulsion compositions comprising a discontinuous oxidizer phase, continuous fuel phase, an emulsifier and a thickener composition comprising a carboxy-containing polymer and a promoter selected from the group consisting of sodium thiocyanate and thiourea.

European Patent application EP 561,600 A discloses a water-in-oil emulsion explosive in which the emulsifier is the reaction product of a substituted succinic acylating agent, having at least 1.3 succinic groups per equivalent weight of substituents, with ammonia and/or an amine. The substituent is a polyalkene having an number average molecular weight of greater than 500 and preferably 1300–1500.

It is an object of the present invention to provide a thickened water in oil emulsion composition having a putty-like consistency, a composition that can be molded. For example, the composition can be formed into a desired shape or can be placed by pressing it into an opening such as an 'uphole' opening without having it flow out of the opening.

SUMMARY OF THE INVENTION

According to the present invention, a putty-like water-in-oil emulsion composition is provided comprising a) an aqueous phase, said aqueous phase comprising water and an inorganic salt, wherein a portion of the inorganic salt is present in aqueous solution and a portion is present in crystalline form, b) an organic phase comprising at least one hydrocarbon, and c) an associated mixture of an emulsifying amount of at least one emulsifying agent comprising at least one of hydroxy groups and amino groups; said emulsifying agent suitable for forming a water-in-oil emulsion, and an acylated hydrocarbon polymer, said hydrocarbon polymer having $\overline{M}_n$ ranging from about 2,000 to about 6,000. This invention also relates to methods for preparing the putty-like emulsions.

DETAILED DESCRIPTION OF INVENTION

As defined herein, a putty is a mixture of a finely divided solid in admixture with a liquid, said mixture having a dough-like consistency. The compositions of the instant invention have a putty-like texture, and are substantially dry to the touch. They can be manually shaped. They can be placed into openings, filling the opening to the desired extent. The emulsion compositions of this invention may be used in applications where a liquid material would be unsuitable, for example in cavities that are open such that a liquid composition would drain from the cavity or in an extensive opening where it is desired to place the emulsion, usually an explosive emulsion, into a limited portion of the cavity without the emulsion flowing into the entire cavity.

In this invention, when the emulsion is sheared in the presence of the polymer, a stable putty-like product is obtained. The putty-like consistency arises from some of the aqueous droplets crystallizing during shear and being generally uniformly dispersed into the composition forming the putty-like texture. An advantage of this invention, compared to an emulsion with no polymer present is that when a polymer-free emulsion shears to form some crystals, the uncrystallized portion of the emulsion will continue to slowly crystallize when the sheared emulsion is left standing undisturbed, eventually destroying the emulsion. In the present inventive emulsions, in the presence of the polymer the uncrystallized emulsion will not continue to crystallize after shearing is discontinued.

It must be noted that as used in this specification and appended claims, the singular forms also include the plural unless the context clearly dictates otherwise. Thus the singular forms "a", "an", and "the" include the plural; for example "a monomer" includes mixtures of monomers of the same type. As another example the singular form "monomer" is intended to include both singular and plural unless the context clearly indicates otherwise.

The term "lower" as used herein in conjunction with terms such as alkyl, alkenyl, alkoxy, and the like, is intended to describe such groups which contain a total of up to 7 carbon atoms.

This invention relates to emulsion compositions in which an aqueous phase is dispersed in a continuous organic phase and which further comprises an associated mixture of emulsifier and acylated hydrocarbon polymer as described in greater detail hereinbelow. The aqueous phase comprises water and an inorganic salt, wherein a portion of the inorganic salt is present in aqueous solution and a portion is present in crystalline form. The organic phase comprises at least one hydrocarbon.

The emulsion is prepared then is subjected to shearing whereupon a portion of the emulsion is broken and a portion of the inorganic salts come out of solution in crystalline form. The crystalline salts are believed to disperse in the organic phase, contributing to formation of the putty-like consistency of the emulsion. As an additional benefit, the putty-like consistency helps to prevent coalescence of the discontinuous aqueous phase, thus contributing to the stability of the emulsion.

The present invention has an advantage over conventional emulsions to which thickeners are added in that those of the present invention can achieve viscosities which are difficult to achieve through the use of thickeners alone. If one adds thickeners to either phase of a conventional emulsion, the liquids eventually become too thick to handle. Emulsification of such thickened liquid phases may be difficult if not impossible. On the other hand, an emulsion can be formed according to the present invention, and thickened to the desired degree by shearing after emulsion formation.

In the present invention, the organic phase may comprise ordinary materials such as diesel oil since the thickening is provided by the presence of the crystalline inorganic salt. In addition, by selection of the shearing conditions, it is possible to control the rate at which the emulsion sets or becomes firm.

Aqueous Phase

The aqueous phase of the inventive emulsion composition comprises inorganic salts. A portion of the salts is dissolved in water and a portion is present as crystalline solids. When the composition is an explosive emulsion or a propellant, the salts comprise oxidizer salts. Such salts include ammonium, alkali metal and alkaline earth nitrates, chlorates, and perchlorates and mixtures of these salts. In one embodiment, inorganic oxidizer salts comprise, principally, ammonium nitrate, although up to about 25% by weight of the oxidizer phase can comprise either another inorganic nitrate (e.g., alkali or alkaline earth metal nitrate) or an inorganic perchlorate (e.g., ammonium perchlorate or an alkali or alkaline earth metal perchlorate) or a mixture thereof.

The aqueous phase is preferably present at a level in the range of from about 70%, often from about 90% up to about 98%, often up to about 95% by weight, frequently from about 80% to about 90% by weight based upon the total weight of the emulsion. The inorganic salt is generally present at a level from about 70% to about 95% by weight, preferably from about 85% to 92% by weight, and more preferably from about 87% to about 90% by weight based on the total weight of the aqueous oxidizer phase.

Organic Phase

The organic phase is the continuous phase of the emulsion. It comprises at least one hydrocarbon. When the emulsion is an explosive emulsion, the hydrocarbon acts as a carbonaceous fuel. Most hydrocarbons are useful in the compositions of this invention, for example, paraffinic, olefinic, naphthenic, aromatic, saturated or unsaturated hydrocarbons, and typically are in the form of an oil or a wax or a mixture thereof. The fuel in explosive or propellant emulsions is a water-immiscible, emulsifiable hydrocarbon that is either liquid or liquefiable at a temperature of up to about 95° C., and preferably between about 40° C. and about 75° C.

Oils from a variety of sources, including natural and synthetic oils and mixtures thereof can be used. The oil that is useful in the inventive emulsions can be a hydrocarbon oil having viscosity values from about 20 SUS (Saybolt Universal Seconds) at 100° F. to about 2500 SUS at 100° F. Mineral oils having lubricating viscosities (e.g. SAE 5-90 grade) can be used.

Examples of useful oils include a white mineral oil available from Witco Chemical Company under the trade designation KAYDOL®; a white mineral oil available from Shell under the trade designation ONDINA®; and a mineral oil available from Pennzoil under the trade designation N-750-HT®. Diesel fuel (e.g., Grade No. 2-D as specified in ASTM D-975) can be used as the oil.

Natural oils include animal oils and vegetable oils (e.g., castor oil, lard oil) as well as solvent-refined or acid-refined mineral lubricating oils of the paraffinic, naphthenic, or mixed paraffin-naphthenic types. Oils of lubricating viscosity derived from coal or shale are also useful.

Synthetic lubricating oils may be used. These include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); alkyl benzenes (e.g., dodecylbenzenes, tetradecylbenzenes, dinonylbenzenes, di-(2-ethylhexyl)benzenes, etc.); polyphenols (e.g., biphenyls, terphenyls, etc.); and the like. Alkylene oxide polymers and interpolymers and derivatives thereof where the terminal hydroxyl groups have been modified by esterification, etherification, etc., constitute another class of known synthetic lubricating oils. These are exemplified by the oils prepared through polymerization of ethylene oxide or propylene oxide, the alkyl and aryl ethers of these polyoxyalkylene polymers.

Another suitable class of synthetic lubricating oils comprises the esters of dicarboxylic acids (e.g., aromatic acids, aliphatic acids, dimer acids, etc.) with a variety of alcohols (mono- and polyols).

Unrefined, refined and re-refined oils (and mixtures of each with each other) of the type disclosed hereinabove can be used in the emulsions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil.

Refined oils are similar to the unrefined oils except that they have been further treated in one or more purification steps to improve one or more properties. Many such purification techniques are known to those of skill in the art such as solvent extraction, acid or base extraction, filtration, percolation, etc. Re-refined oils, are also known as reclaimed or reprocessed oils, are obtained by processes similar to those used to obtain refined oils applied to refined oils which have been already used in service. Such re-refined oils often are additionally processed by techniques directed to removal of spent additives and oil breakdown products.

It may be desirable to include small amounts of silicon based oils as additives in the oil phase. These oils tend to make the composition more resistant to moisture in the environment. Useful silicon-based oils include materials such as the polyalkyl-, polyaryl-, polyalkoxy-, or polyaryloxy-siloxanes.

The organic phase may contain any wax having melting point of at least about 25° C. and generally below 90° C., such as petrolatum wax, microcrystalline wax, and paraffin wax, mineral waxes such as ozocerite and montan wax, animal waxes such as spermaceti wax, and insect waxes such as beeswax and Chinese wax. Useful waxes include waxes identified by the trade designation MOBILWAX® 57 which is available from Mobil Oil Corporation; D02764 which is a blended wax available from Astor Chemical Ltd.; and VYBAR® which is available from Petrolite Corporation. Preferred are blends of microcrystalline and paraffin waxes.

In one embodiment, the carbonaceous fuel includes a combination of a wax and an oil. In this embodiment the wax content can be at least about 25% to about 60% by weight of the organic phase, and the oil content can be at least about 40%.

The organic phase is generally present at a level from 2%, often from about 5% up to about 30% by weight, often up to about 10% to 20% by weight, and frequently in the range of from about 3.5% to about 8% by weight, based on the total weight of the emulsion.

When the emulsion is an explosive emulsion or a propellant, the aqueous phase comprising at least one oxygen-supplying component and the organic phase comprises at least one material which can serve as an organic fuel.

Emulsifying Agent

The emulsifying agent is one suitable for preparing water in oil emulsions and comprises at least one of hydroxy substituent groups and amino substituent groups, especially hydroxyalkyl and aminoalkyl substituent groups. Emulsifiers suitable for use with emulsion explosives and propellants are preferred for use in the present invention. Especially preferred are those having hydrophilic-lipophilic balance (HLB) ranging from 1 to about 7. The emulsifier serves to establish an emulsion in which water droplets containing the inorganic salts are dispersed in the continuous organic phase. Suitable emulsifiers are stable to the conditions under which the emulsion is formed. Such emulsifiers generally consist of molecules with both a hydrophilic and a lipophilic portion. The lipophilic portion of the emulsifier may be either monomeric or polymeric in nature, provided that it contains a chain structure of sufficient length to confer the necessary emulsification characteristics. The chain structure should incorporate a backbone sequence of at least 10, and preferably not more than 500, linked atoms; these may be entirely carbon atoms, or they may be predominantly carbon atoms interrupted by heteroatoms such as oxygen or nitrogen. Desirably, the lipophilic portion includes a terminal reactive grouping, such as a hydroxyl, amino, carboxyl or carboxylic acid anhydride group, to promote linkage of the lipophilic portion to an appropriate hydrophilic portion.

Preferred emulsifying agents comprise at least one hydrocarbyl substituted carboxylic emulsifier composition, preferably one wherein the hydrocarbyl group is an aliphatic group. Often, the aliphatic hydrocarbyl group has $\overline{M}_n$ ranging from about 600 to about 5,000. Frequently, the aliphatic hydrocarbyl group is an alkenyl group. Preferred polyalkenyl groups are derived from at least one polymer selected from the group consisting of polybutenes, especially polyisobutylene, polypropylene, ethylene-propylene copolymer, ethylene-propylene-polyene copolymer and styrene-diene copolymer. Highly unsaturated polymers may be, and frequently are, hydrogenated to reduce the amount of olefinic unsaturation present in the polymer. They are usually not exhaustively hydrogenated. In particular, ethylene propylene-polyene copolymers and styrene-diene copolymers are frequently hydrogenated.

Preferred emulsifiers comprise at least one of esters, amides, imides and salts. When the emulsifying agent is a polycarboxylic composition, mixtures of these such as ester-salts, ester-amides, etc are useful.

Succinic emulsifiers are preferred carboxylic emulsifying agents. Especially preferred succinic emulsifiers comprise at least one of succinic ester-acid salt groups, succinic amide-acid groups, succinic diester groups, succinic diamide groups, succinimide groups and mixtures thereof. Preferably, at least about 60% of these groups have aminoalkyl or hydroxyalkyl substituents.

Succinic acylating agents useful in preparing emulsifiers include hydrocarbyl-substituted succinic acids and anhydrides which may be represented by the formulae:

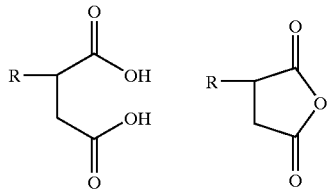

wherein R is a $C_{10}$ to about a $C_{500}$ hydrocarbyl group. Preferably, R is an aliphatic or alicyclic hydrocarbyl group with less than about 10% of its carbon-to-carbon bonds being unsaturated. R may derived from olefin polymers. R may also be derived from non-polymerized olefins of from 10 to about 18 carbon atoms with alpha-olefins being particularly useful.

Succinic ester-acid salt groups may be derived from secondary or tertiary alkanol amines. Succinic amide-acid groups may be derived from secondary alkanol amines. Succinic diester groups may be derived from tertiary alkanol amines. Succinic diamide groups may be derived from at least one of primary and secondary amines. Succinimide groups may be derived from at least one of primary alkanol amine and primary alkylene polyamines having at least one primary amino group. Succinic ester groups may be derived from polyhydroxy compounds. In a preferred embodiment, the succinic emulsifier composition is made by reaction of 1 mole of at least one polyalkenyl group substituted succinic acylating agent with from about 0.9 to about 1.1 mole of at least one secondary or tertiary alkanolamine.

A saturated or unsaturated hydrocarbon chain derived, for example, from a polymer of a mono-olefin, the polymer chain containing from about 40 to about 500 carbon atoms is useful. Suitable polyolefins include those derived from olefins containing from 2 to 6 carbon atoms, in particular ethylene, propylene, butene-1 and isoprene, but especially isobutene. Conveniently, this portion of the molecule may be provided by a poly[alk(en)yl]succinic anhydride and functional equivalents thereof.

Functional equivalents of the anhydride are materials which will react as acylating agents in a manner similar to that of the anhydride. These include the corresponding acids, esters, usually lower alkyl esters and acyl halides.

These are commercially available materials which are made by an addition reaction at an elevated temperature between a polyolefin containing a terminal unsaturated group and maleic anhydride, optionally in the presence of a halogen catalyst. Typical poly(alk(en)yl)succinic anhydrides have a number average molecular weight in the range 400 to 5000. The succinic anhydride residue in the above-mentioned compounds provides a convenient means of attaching the lipophilic hydrocarbon chain to the hydrophilic moiety of the emulsifier.

The use of amine salts of derivatives of substituted succinic acylating agents as emulsifiers in emulsion explosives is disclosed in U.S. Pat. No. 4,708,753. Similarly, the alkali metal and alkaline earth metal salts of such derivatives are usable as emulsifiers.

Especially preferred succinic emulsifiers comprise at least one of succinic ester-acid salt groups, succinic amide-acid groups, succinic diester groups, succinic diamide groups, succinimide groups and mixtures thereof.

U.S. Pat. Nos. 5,047,175; and 4,828,633 describe emulsifiers that are a salt derived from a high molecular weight carboxylic acylating agent coupled to a low molecular weight carboxylic acylating agent. Succinic acids and anhydrides are the preferred acylating agents. U.S. Pat. Nos. 5,512,079 and 5,518,517 disclose emulsion fertilizers. The emulsifiers prepared from succinic acylating agents disclosed in these four patents are useful in the present invention.

Another suitable emulsifier is a reaction product of an amine characterized by the presence within its structure of at least one H—N group and an intermediate formed in the reaction of at least one olefinic compound containing at least one group of the formula

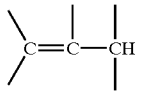

(I)

and at least one carboxylic reactant selected from the group consisting of compounds of the formula $$R^3C(O)(R^4)_nC(O)OR^5 \quad \text{(III)}$$

wherein each of $R^3$ and $R^5$ is independently H or a hydrocarbyl group, $R^4$ is a divalent hydrocarbylene group, and n is 0 or 1, and reactive sources thereof, and optionally, at least one aldehyde or ketone. These are described in U.S. Pat. No. 6,054,493 which is hereby incorporated herein by reference for relevant disclosures in this regard.

Other suitable emulsifiers include sorbitan esters, such as sorbitan sesquioleate, sorbitan monooleate, sorbitan monopalmitate, sorbitan monostearate and sorbitan tristearate, the mono- and diglycerides of fat-forming fatty acids, soybean lecithin and derivatives of lanolin, such as isopropyl esters of lanolin fatty acids, mixtures of higher molecular weight fatty alcohols and wax esters, ethoxylated fatty ethers, such as polyoxyethylene (4) lauryl ether, polyoxyethylene (2) oleyl ether, polyoxyethylene (2) stearyl ether, polyoxyalkylene oleyl laurate, and substituted oxazolines such as 2-oleyl-4-4'-bis(hydroxymethyl)-2-oxazoline. Suitable mixtures of such conventional emulsifiers may also be selected. Frequently, these are used as co-emulsifiers. The co-emulsifiers comprise auxiliary surfactants, typically having HLB ranging from 1 to about 12.

The emulsifier generally makes up between 0.5 to 2% of the total emulsion composition. Preferably the amount of the emulsifier ranges from 1 to 1.5% of the total composition.

The lipophilic portion of the emulsifying agent may be a hydrocarbon chain formed by the polymerization of an olefin. Suitable olefins include ethylene, propylene, butene and hexene. However, the lipophilic portion of the molecule is not limited to polymerized olefins. More generally, the lipophilic portion of the molecule may be any hydrocarbyl group which can include:

(1) hydrocarbyl groups, that is, aliphatic (e.g., alkyl or alkenyl), alicyclic (e.g., cycloalkyl, cycloalkenyl), aromatic, aliphatic- and alicyclic-substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups which, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups which, while having predominantly hydrocarbyl character within the context of this invention, contain other than carbon in a ring or chain otherwise composed of carbon atoms. Suitable heteroatoms will be apparent to those of skill in the art and include, for example, sulfur, oxygen, nitrogen and such substituents as pyridyl, furanyl, thiophenyl, imidazolyl, etc.

In general, no more than about three non-hydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbyl.

The hydrocarbyl groups are preferably free from acetylenic unsaturation; ethylenic unsaturation, when present will generally be such that there is no more than one ethylenic linkage present for every ten carbon-to-carbon bonds. The hydrocarbyl groups are often completely saturated and therefore contain no ethylenic unsaturation. Whatever the structure, the hydrocarbyl group provides oil solubility.

Copolymers of maleic acid or maleic anhydride with various ethylenically unsaturated species, such as styrene and $C_{2-30}$ alkenes are useful emulsifying agents. Such copolymers include several carboxyl groups within the polymer chain. In one embodiment, these copolymers may be partially esterified with individual alcohols ($C_8$ to about $C_{30}$) or alcohol mixtures ($C_4$–$C_{50}$). Similar copolymers may be formed from methacrylic acid, acrylic acid, crotonic acid and itaconic acid. The copolymers prepared with the various unsaturated acids may and preferably will contain more than one acid group per molecule. A poly-acid may be partially esterified to form an acid containing ester which can function as a cross-linkable material. If the partial ester is further partially reacted with a base to form a partial salt, the acid/ester in its partially salted form may serve as the emulsifier. In this case, the remaining unreacted acid sites are available for a cross-linking reaction. The emulsifying agent is usually present in amounts ranging from about 4% to about 40% based on the total weight of the organic phase.

Acylated Hydrocarbon Polymer

The emulsion compositions of this invention comprise an associated mixture of an emulsifying amount of at least one emulsifying agent as described herein and an acylated hydrocarbon polymer, said hydrocarbon polymer having $\overline{M}_n$ ranging from about 2,000 to about 6,000. The acyl group may be in the form of a carboxylic acid. However, it is preferred that the acyl groups be in the form of an anhydride or a low molecular weight ester. Methyl and ethyl esters are particularly preferred esters.

Acylated hydrocarbon polymer typically contain an average of from about 1 to about 6 acyl group containing monomers per polymer chain. The acylated hydrocarbon polymer may be prepared by copolymerizing acyl group containing monomers with hydrocarbon monomers or by grafting one or more acyl group containing monomers onto a hydrocarbon polymer. In one preferred embodiment, the acylated hydrocarbon polymer is an ethylene-propylene copolymer having grafted thereon an average of from 1 to about 6 maleic anhydride monomers per polymer chain. Such acylated hydrocarbon polymers are commercially available, for example under the tradename LUCANT® (Mitsui Chemicals Co., Japan) and RICON® MA (Ricon Resins, Grand Junction Colo.).

A wide variety of acylated hydrocarbon polymers is useful. The hydrocarbon polymers include such materials as hydrogenated polymers of dienes, hydrogenated copolymers of a conjugated diene with vinyl substituted aromatic compounds, polymers of alpha olefins containing from 2 to about 28 carbon atoms, and olefin-diene copolymers. The hydrocarbon polymers and acylated derivatives thereof are well known in the art and are described in numerous patent publications including, for example, U.S. Pat. No. 5,811,378 and U.S. Pat. No. 5,401,341.

Especially preferred hydrocarbon polymers are olefin copolymers, i.e., polyolefins, particularly ethylene-alpha olefin copolymers.

Copolymers obtained by copolymerizing acyl group containing monomers with hydrocarbon monomers such as olefins, polyenes, especially dienes, vinyl aromatic monomers and the like, and mixtures thereof are also well known.

In one preferred embodiment, the polyolefin is an ethylene-olefin, preferably alpha olefin, copolymer wherein the olefin contains from 3 to about 28 carbon atoms.

Useful acyl group containing monomers include ethylenically unsaturated carboxylic acids or functional equivalents thereof. The most commonly used materials contain from 2 to about 20 carbon atoms exclusive of carbonyl carbons. They include such acids as acrylic acid, methacrylic acid, maleic acid, fumaric acid, crotonic acid, citraconic acid, itaconic acid and mesaconic acid, as well as their anhydrides, halides and esters (especially the lower alkyl esters, the term "lower alkyl" meaning alkyl groups having up to 7 carbon atoms). The preferred compounds are the alpha-beta-olefinic carboxylic acids, especially those containing at least two carboxy groups and more especially dicarboxylic acids, and their derivatives. Maleic acid and maleic anhydride, especially the latter, are particularly preferred.

The ethylenically unsaturated carboxylic acid is generally employed in amounts ranging from about 1 to about 6 mole per mole, based on $\overline{M}_n$ of polymer, providing an acylated polymer containing from 1 to about 6 acyl groups per polymer chain.

The acylated hydrocarbon polymer is generally present in amounts ranging from about 0.1 to about 3% by weight based on the total weight of the emulsion composition.

Associated Mixture

The compositions of this invention comprise an associated mixture of an emulsifying amount of at least one emulsifying agent comprising at least one of hydroxy groups and amino groups; said emulsifying agent suitable for forming a water-in-oil emulsion, and an acylated hydrocarbon polymer, said hydrocarbon polymer having $\overline{M}_n$ ranging from about 2,000 to about 6,000. The association arises from interaction of the acyl groups of the acylated hydrocarbon polymer with the hydroxy or amino groups of the emulsifier.

Basic Alkaline Earth Component

The compositions of this invention may further comprise a basic alkaline earth metal containing component. This additional component serves to enhance and accelerate the initial thickening of the emulsion composition before it is subjected to shearing. Without wishing to be bound by theory, it is believed that this effect arises from interaction of the basic alkaline earth metal containing compound with acyl groups of the emulsifier and/or the acylated hydrocarbon polymer.

Useful alkaline earth metal containing components include compounds selected from the group consisting of carbonates, hydroxides, oxides, sulfonates, carboxylates, phenates and mixtures of two or more of these. Preferably, the alkaline earth metal containing component is a calcium or a magnesium compound.

Explosive Emulsions. Additional Components

Explosive emulsions typically contain other additives such as sensitizing components, oxygen-supplying salts, particulate light metals, particulate solid explosives, soluble and partly soluble self-explosives, explosive oils and the like for purposes of augmenting the strength and sensitivity or decreasing the cost of the emulsion.

The sensitizing components are distributed substantially homogeneously throughout the emulsions. These sensitizing components are preferably closed-cell, void-containing materials, that is, particulate materials that comprise closed-cell, hollow cavities, for example, occluded gas bubbles which may be introduced in the form of glass or resin microspheres or other gas-containing particulate materials. Alternatively, gas bubbles may be generated in situ by adding to the composition and distributing therein a gas-generating material such as, for example, an aqueous solution of sodium nitrite. Other suitable sensitizing components which may be employed alone or in addition to the occluded or in-situ generated gas bubbles include insoluble particulate solid self-explosives such as, for example, grained or flaked TNT, DNT, RDX and the like, and water-soluble and/or hydrocarbon-soluble organic sensitizers such as, for example, amine nitrates, alkanolamine nitrates, hydroxyalkyl nitrates, and the like. The explosive emulsions of the present invention may be formulated for a wide range of applications. Any combination of sensitizing components may be selected in order to provide an explosive composition of virtually any desired density, weight-strength, or critical diameter.

The quantity of solid self-explosive ingredients and of water-soluble and/or hydrocarbon-soluble organic sensitizers may comprise up to about 40% by weight of the total emulsion. The volume of the occluded gas component may comprise up to about 50% of the volume of the total explosive emulsion.

Optional additional materials may be incorporated in the explosive emulsions of the invention in order to further improve sensitivity, density, strength, rheology and cost of the final explosive. Typical of materials found useful as optional additives include, for example, emulsion promotion agents such as highly chlorinated paraffinic hydrocarbons, particulate oxygen-supplying salts such as prilled ammonium nitrate, calcium nitrate, perchlorates, and the like, particulate metal fuels such as aluminum, silicon and the like, particulate non-metal fuels such as sulfur, gilsonite and the like, particulate inert materials such as sodium chloride, barium sulphate and the like, water phase thickeners such as guar gum, polyacrylamide, carboxymethyl or ethyl cellulose, biopolymers, starches, and the like, buffers or pH controllers such as sodium borate, zinc nitrate and the like, and additives of common use in the explosives art.

Specific examples of sensitizers and additional components are given in U.S. Pat. No. 5,401,341 which is incorporated herein by reference for relevant disclosures in this regard.

Propellant Compositions

When the energetic emulsions of the present invention are used as rocket propellants, it is important to slow the rate of reaction so as to produce controlled combustion. Inadvertent inclusion of gas within the emulsion should be avoided since gas bubbles serve as sensitizers. The rate of reaction may be slowed by the use of well-known additives, or through the use of particulate fuels which burn more slowly than the oil used to create the emulsion. Sawdust, wood chips, nut shells, etc. are good examples of such particulate fuels.

The emulsions may be formed by methods well known to those skilled in the art. One common method is to mix the emulsifier with the organic phase to form an emulsifiable organic phase. The salts and other water soluble components, if any, are mixed with water at an elevated temperature sufficient to cause the formation of a solution. The organic and the aqueous phases are brought together and mixed at a low shear rate to form a pre-emulsion and then at a higher rate to form the final emulsion. The emulsion is then mixed with the acylated hydrocarbon polymer and the resulting mixture is subjected to shearing. Alternatively, the acylated hydrocarbon polymer may be incorporated into the organic phase before the emulsion is formed. Suspended components such as sensitizers, added fuels, and added oxidizers may be added after the emulsion is formed.

Although the invention is not limited to a particular method of forming the emulsion, it is generally advantageous to form the emulsion first and then finally, to shear the emulsion to generate the thickened emulsion. Often, the emulsion is formed and then stirring is continued to introduce the acylated hydrocarbon polymer into the system followed by shearing. In certain cases, it is desirable to prepare the emulsion, transport it to the site where it is to be used and introduce the acylated hydrocarbon polymer then to shear the emulsion as the emulsion is being placed for use. This procedure would be especially applicable to mining situations where it is desired to have an emulsion which can be pumped into a hole, but which sets shortly after it is put in place. Overhead vertical boreholes would be an example of such a situation.

Shearing

Shearing of the emulsion is conducted using equipment that provides stirring or mixing of materials at variable but controlled rates. Industrial mixers and household food processors are useful wherein the rate of mixing and shearing is controlled by varying the power supplied to the device. The nature of the mixing device, such as a wire whisk or a sharpened blade also affect the shearing effect.

EXAMPLES

The following examples illustrate emulsion composition of this invention and means for preparing them. These examples are intended to be illustrative only and are not intended to limit the scope of the invention. Unless indicated otherwise, all parts are parts by weight and temperatures are in degrees Celsius. All analytical values are by analysis.

Master Emulsion

An aqueous component containing 757 parts ammonium nitrate, 189 parts tap water, 02.4 parts $Zn(NO_3)_2$, and 0.23 parts sodium carbonate is heated with mixing to 74° C. An organic component containing 13.3 parts of a 52% in mineral oil solution of a half-ester salt, half amide ester prepared by reacting polyisobutenyl ($\overline{M}_n$) substituted succinic anhydride with diethanol amine (the emulsifier), 6.6% sorbitan monooleate (co-emulsifier) and 34 parts diesel fuel oil is also heated with mixing to 74° C. The aqueous component is poured into the organic component in the bowl of a high shear mixer (Hobart brand, oscillatory industrial mixer with whisk attachment) with mixing for 1 minute at 30% power, 600 RPM. The power is increased to 50%, 800 RPM, and the emulsion is formed by mixing for 1 more minute. The emulsion has initial viscosity of 40,000 centipoise at 90°.

Example 1

To 490 parts of the above emulsion are added 10 parts of a (2:1) weight mixture of maleinated ethylene-alpha olefin copolymer (LUCANT 6020H) in pale 40 mineral oil. The emulsion is allowed to remain undisturbed until it reaches room temperature whereupon it thickens to a gel-like consistency. Low shear is applied with a Braun food processor/mixer, 600 RPM, to this emulsion forming a moldable, pliable putty.

Example 2

The procedure of Example 1 is repeated replacing the LUCANT polymer with 10 parts of a maleinated polybutadiene (MW 5000–5400) (RICON 131 MA-12, Ricon Resins, Grand Junction Colo., USA).

Each of the documents referred to above is incorporated herein by reference. Except in the examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amounts, ranges, and ratio limits set forth herein may be independently combined. As used herein, the expression "consisting essentially of" permits the inclusion of substances which do not materially affect the basic and novel characteristics of the composition under consideration.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A water-in-oil emulsion composition including a) an aqueous phase, said aqueous phase comprising water and an inorganic salt, wherein a portion of the inorganic salt is present in aqueous solution and a portion is present in crystalline form, b) an organic phase comprising at least one hydrocarbon, and c) an associated mixture of an emulsifying amount of at least one emulsifying agent comprising at least one of hydroxy groups and amino groups; said emulsifying agent suitable for forming a water-in-oil emulsion, and wherein the improvement comprises adding an acylated hydrocarbon polymer, said hydrocarbon polymer having $\overline{M}_n$ ranging from about 2,000 to about 6,000 which is characterized by imparting a putty-like consistency to said emulsion rather than being a fluid which flows under its own weight.

2. The composition of claim 1 wherein the emulsifying agent comprises a composition having HLB ranging from about 1 to about 7.

3. The composition of claim 1 wherein the composition is an explosive emulsion wherein a) the aqueous phase is an oxidizer phase comprising at least one oxygen supplying component; and b) the organic phase comprises at least one organic fuel.

4. The composition of claim 3 wherein said oxygen supplying component comprises at least one of ammonium nitrate and alkali or alkaline earth metal nitrates, chlorates and perchlorates.

5. The composition of claim 3 wherein said organic fuel comprises a carbonaceous fuel that is a water-immiscible, emulsifiable hydrocarbon that is either liquid at about 20° C. or liquefiable at a temperature below about 95° C.

6. The composition of claim 1 wherein the emulsifying agent comprises at least one aliphatic hydrocarbyl group substituted carboxylic emulsifier composition.

7. The composition of claim 6 wherein the aliphatic hydrocarbyl group of the emulsifying agent is a polyalkenyl group derived from at least one member of the group consisting of polybutenes, polypropylene, ethylene-propylene copolymer, ethylene-propylene-polyene copolymer and partially hydrogenated styrene-diene copolymers.

8. The composition of claim 7 wherein the polyalkenyl group is derived from polyisobutylene.

9. The composition of claim 6 wherein the carboxylic emulsifier composition comprises a succinic emulsifier composition.

10. The composition of claim 9 wherein the succinic emulsifier comprises at least one of succinic ester-acid salt groups, succinic amide-acid groups, succinic diester groups, succinic diamide groups, succinimide groups and mixtures thereof.

11. The composition of claim 6 wherein the aliphatic hydrocarbyl group of the emulsifying agent has $\overline{M}_n$ ranging from about 600 to about 5,000.

12. The composition of claim 9 wherein the succinic emulsifier comprises ester-acid salt groups derived from secondary or tertiary alkanol amines.

13. The composition of claim 9 wherein the succinic emulsifier comprises succinic diamide groups derived from at least one of primary and secondary amines.

14. The composition of claim 9 wherein the succinic emulsifier comprises ester groups derived from polyhydroxy compounds.

15. The composition of claim 3 wherein the organic fuel comprises at least one member of the group consisting of diesel oil, mineral oil, vegetable oil and hydrocarbon wax.

16. The composition of claim 1 wherein the acylated hydrocarbon polymer is prepared by grafting acyl group containing monomers onto a substantially hydrocarbon polymer.

17. The composition of claim 1 wherein the acylated hydrocarbon polymer is prepared by copolymerizing acyl group containing monomers with hydrocarbon monomers.

18. The composition of claim 1 wherein the acylated hydrocarbon polymer is an ethylene-propylene copolymer having grafted thereon an average of from about 1 to about 6 maleic anhydride monomers per polymer chain.

19. The composition of claim 9 wherein the succinic emulsifier composition is made by reaction of 1 mole of at least one polyalkenyl group substituted succinic acylating agent with from about 0.9 to about 1.1 mole of at least one secondary or tertiary alkanolamine.

20. The composition of claim 1 wherein the continuous organic phase is present in amounts ranging from about 2% to about 10% by weight, the discontinuous aqueous phase is present in amounts ranging from about 90% to about 98% by weight, both based on the total weighs of the emulsion composition, said inorganic salt is present at a level in the range of about 70% to about 95% by weight based on the weight of said aqueous phase, the emulsifying agent is present in amounts ranging from about 4% to about 40% by weight based on the total weight of the organic phase and the acylated hydrocarbon polymer is present in amounts ranging from about 0.1 to about 3% by weight based on the total weight of the emulsion composition.

21. A composition comprising an associated mixture of (A) an acylated hydrocarbon polymer, said hydrocarbon polymer having $\overline{M}_n$ ranging from about 2,000 to about 6,000; and (B) at least one aliphatic hydrocarbyl group substituted carboxylic composition comprising at least one of ester groups, amide groups, imide groups and salt groups and mixtures thereof, said carboxylic composition having at least one of hydroxy groups and amino groups wherein A and B react to form a material with putty-like consistency.

22. The composition of claim 21 wherein the carboxylic composition comprises at least one of a hydrocarbyl group substituted succinic ester-acid salt, succinic amide-acid, succinic diester, succinic diamide and succinimide and mixtures thereof.

23. A method for preparing a water in oil emulsion composition comprising 1) preparing an aqueous component comprising water and an 1inorganic salt;

2) preparing an organic component comprising a hydrocarbon, an emulsifying amount of at least one emulsifying agent comprising at least one of hydroxy groups and amino groups; said emulsifying agent suitable for forming a water-in-oil emulsion, 3) preparing an emulsion by mixing the aqueous component and the organic component;

4) mixing the emulsion and an acylated hydrocarbon polymer, said hydrocarbon polymer having $\overline{M}_n$ ranging from about 2,000 to about 6,000; then 5) shearing the emulsion, wherein subsequent to shearing said acylated hydrocarbon polymer is characterized as interacting to impart putty-like consistency to said emulsion composition.

24. A method for preparing a putty-like water in oil emulsion composition comprising 1) preparing an aqueous component comprising water and an inorganic salt;

2) preparing an organic component comprising a hydrocarbon, an emulsifying amount of at least one emulsifying agent comprising at least one of hydroxy groups and amino groups; said emulsifying agent suitable for forming a water-in-oil emulsion, and an acylated hydrocarbon polymer, said hydrocarbon polymer having $\overline{M}_n$ ranging from about 2,000 to about 6,000;

3) preparing an emulsion by mixing the aqueous component and the organic component; then 4) shearing the emulsion, wherein subsequent to shearing said acylated hydrocarbon polymer is characterized as interacting to impart putty-like consistency to said emulsion composition.

* * * * *